US007013586B1

(12) United States Patent
Hatfield et al.

(10) Patent No.: US 7,013,586 B1
(45) Date of Patent: Mar. 21, 2006

(54) ARTICLE OF ATHLETIC FOOTWEAR WITH A LEASH

(75) Inventors: Tobie D. Hatfield, Beaverton, OR (US); Tinker L. Hatfield, Portland, OR (US)

(73) Assignee: Nike, Inc., Beaverton, OR (US)

( * ) Notice: Subject to any disclaimer, the term of this patent is extended or adjusted under 35 U.S.C. 154(b) by 11 days.

(21) Appl. No.: 10/340,194

(22) Filed: Jan. 10, 2003

(51) Int. Cl.

| | |
|---|---|
| ***A43B 23/28*** | (2006.01) |
| ***A43B 3/12*** | (2006.01) |
| ***A43B 7/20*** | (2006.01) |
| ***A43B 23/00*** | (2006.01) |

(52) U.S. Cl. ..... 36/58.6; 36/89; 36/11.5; 36/136

(58) Field of Classification Search ..... 36/58.5, 36/58.6, 89, 1, 109, 56, 11.5, 114, 132, 136
See application file for complete search history.

(56) References Cited

U.S. PATENT DOCUMENTS

| | | | | |
|---|---|---|---|---|
| 916,061 A | * | 3/1909 | Thorsch | 36/58.5 |
| 993,212 A | * | 5/1911 | Wheeler | 36/58.5 |
| D85,954 S | * | 1/1932 | Noble | 36/89 |
| 2,847,991 A | | 8/1958 | Andrews | |
| 3,327,410 A | | 6/1967 | Park, Sr. et al. | |
| 4,282,657 A | | 8/1981 | Antonious | |
| 4,411,077 A | | 10/1983 | Slavitt | |
| 4,489,719 A | | 12/1984 | Lapenskie | |
| 4,523,394 A | * | 6/1985 | Lindh et al. | 36/89 |
| 4,577,419 A | | 3/1986 | Chassaing | |
| 4,621,648 A | | 11/1986 | Ivany | |
| 4,676,011 A | | 6/1987 | O'Rourke et al. | |
| 4,922,630 A | | 5/1990 | Robinson | |
| 5,038,499 A | * | 8/1991 | Martinez, Jr. | 36/58.5 |
| 6,082,026 A | | 7/2000 | Sand et al. | |

FOREIGN PATENT DOCUMENTS

| | | | |
|---|---|---|---|
| WO | WO 94/04049 | * | 3/1994 |

* cited by examiner

*Primary Examiner*—Anthony Stashick
(74) *Attorney, Agent, or Firm*—Banner & Witcoff, Ltd.

(57) ABSTRACT

An article of footwear is disclosed that includes an upper, a sole structure, and a leash secured to the upper. The leash is formed of a flexible material and includes a connector strap that extends from a heel portion of the upper. A pair of straps extend from the connector strap and are configured to extend around opposite sides of an ankle. A fastener is secured to opposite sides of the straps and is utilized to secure the leash to the ankle. The leash secures the footwear to the individual, thereby limiting inadvertent removal of the footwear from the foot.

13 Claims, 8 Drawing Sheets

ARTICLE OF ATHLETIC FOOTWEAR WITH A LEASH

BACKGROUND OF THE INVENTION

1. Field of the Invention

The present invention relates to footwear and concerns, more particularly, a leash that secures an article of athletic footwear to a foot of an individual. The invention has application to types of athletic footwear that may become inadvertently removed from the foot during an athletic competition or training session.

2. Description of Background Art

A conventional article of athletic footwear has two primary elements, an upper and a sole structure. The upper generally includes multiple elements that are stitched or adhesively bonded together to form a void on the interior of the footwear for comfortably receiving a foot. The sole structure is secured to a lower surface of the upper and provides a ground-engaging portion of the footwear that imparts traction.

In manufacturing an article of footwear, the elements forming the upper are generally assembled around a last that has the approximate shape of a foot. Once the upper is assembled, the sole structure is secured to the upper and the last is removed. The void within the upper has the approximate shape of the foot, as imparted from the last. Many individuals, however, will have a foot with proportions that vary from the specific proportions of the last. Accordingly, many articles of footwear, including athletic footwear, incorporate a lacing system that adjusts the size of the void to accommodate a feet with varying proportions. The lacing system is also utilized to tighten the upper around the foot, thereby securing the footwear to the foot.

Although the lacing system is generally sufficient to secure the footwear to the foot, situations regularly arise during athletic competitions and training sessions where an article of footwear may be inadvertently removed from the foot. While running, for example, one individual may step on the heel portion of another individual's footwear, thereby causing the footwear to become dislodged from the foot. A similar result may occur during the game of football when one individual is being tackled by another individual. Furthermore, footwear may become dislodged in other sports such as soccer and basketball, for example.

One method in which athletes attempt to limit the probability that footwear will become inadvertently removed from the foot is to place excess tension in the lacing system. Although this may be an effective method of limiting inadvertent removal of the footwear, this method may also be uncomfortable and may cause chafing or the development of blisters due to the excess tightness of the upper around the foot. Another method utilized by athletes to limit the probability that footwear will become inadvertently removed from the foot is to wrap the footwear and ankle with tape. A drawback to this method, however, is that the tape may cover a portion of the sole structure, thereby limiting the degree of traction provided by the sole structure. In addition to wasting a relatively large amount of tape, the latter method may add weight to the footwear and time to the process of placing the footwear upon the foot and removing the footwear from the foot. Furthermore, the placing tape on the exterior of the footwear detracts aesthetically from the footwear and may impart a perception that the footwear does not function as intended.

SUMMARY OF THE INVENTION

The present invention is an article of athletic footwear having an upper, a sole structure, and a leash. The upper has an interior surface that defines a void for receiving a foot, and the upper forms an ankle opening that provides access to the void. The sole structure is secured to a lower portion of the upper. The leash is formed of a flexible material and is secured, or detachably-secured, to the upper to limit removal of the footwear from the foot. The leash has a configuration that extends outward from the upper proximal a rear portion of the ankle opening to permit inversion, eversion, dorsiflexion, and plantarflextion of the foot, and the leash includes at least one strap that is spaced from the ankle opening. The strap is configured to extend around the ankle. A fastener may be utilized to secure the strap around the ankle. As utilized herein, the term ankle is intended to refer generally to a lower portion of the leg.

In one embodiment, the leash includes a connector strap, a first strap, and a second strap. A first end of the connector strap is secured to a heel portion of the upper, and a second end of the connector strap is secured to the first strap and the second strap. Accordingly, the leash may have a configuration that is Y-shaped, wherein the connector strap forms the vertical segment, and the first strap and the second strap form the inclined segments. In this configuration, an upper end of the connector strap is positioned below an elevation of a lateral malleolus and a medial malleolus of the ankle, and the incline in the first strap and the second strap permit the leash to extend over the lateral malleolus and medial malleolus.

The manner in which the leash is secured to the upper may vary significantly. For example, the connector strap may be permanently secured to the interior surface of the upper, or may be positioned within layers of material that form the upper. Alternately, a hook-and-loop fastener may be utilized to detachably-secure the leash to the upper. In this manner an individual may selectively remove the leash from the footwear. A hook-and-loop fastener may also be positioned on opposite sides of the first strap and the second strap to secure the leash around the ankle. In addition to the positions discussed above, the leash may be secured to the exterior of the upper.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
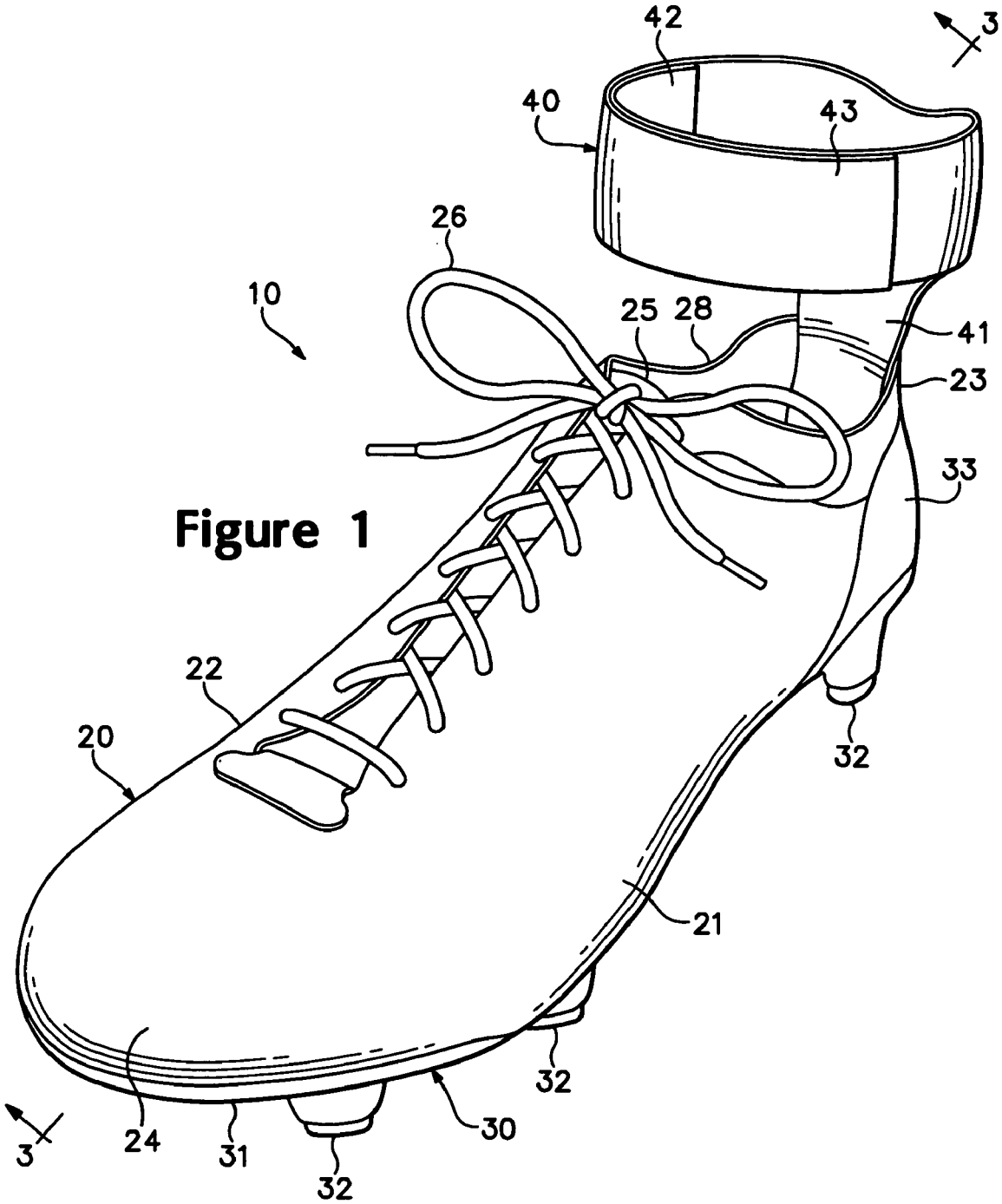
FIG. 1 is a perspective view of an article of footwear having a leash in accordance with the present invention.

The following discussion and accompanying figures disclose an article of athletic footwear with a leash that secures the footwear to a foot of an individual and limits inadvertent removal of the foot from the footwear during an athletic competition or training session. Concepts related to the leash are disclosed with reference to footwear having a configuration that is suitable for the sport of soccer and the sport of basketball. The invention is not solely limited to footwear designed for soccer and basketball, however, and may be applied to a wide range of athletic footwear styles that include running shoes, walking shoes, cross-training shoes, tennis shoes, and football shoes, for example. Accordingly, one skilled in the relevant art will appreciate that the concepts disclosed herein apply to a wide variety of athletic footwear styles, in addition to the specific style discussed in the following material and depicted in the accompanying figures.

An article of footwear 10 in accordance with the present invention is depicted in FIGS. 1–6 and includes an upper 20, a sole structure 30, and a leash 40. In general, upper 20 is formed of a plurality elements that are stitched or adhesively bonded together to form a hollow structure for comfortably-receiving the foot. Sole structure 30 is secured to a lower surface of upper 20 to provide support for the foot and a relatively high degree of traction on a playing field. Leash 40 extends upward from upper 20 and has a configuration that wraps around an ankle of the individual to secure footwear 10 to the foot. Additional detail concerning the manner in which leash 40 operates is provided below. As utilized herein, the term ankle is intended to refer generally to a lower portion of the leg.

Upper 20 has a substantially conventional configuration. The various materials forming upper 20 combine to provide a generally hollow structure having a lateral side 21, an opposite medial side 22, a heel portion 23, a toe portion 24, and a tongue 25. In addition, upper 20 incorporates a lace 26 that extends over tongue 25 and through apertures formed in lateral side 21 and medial side 22. The interior surfaces of lateral side 21, medial side 22, heel portion 23, toe portion 24, and tongue 25 define a void 27 for receiving the foot, and an ankle opening 28 provides access to void 27.

Lateral side 21 is generally configured to contact and cover a lateral surface of the foot, and a portion of lateral side 21 extends over an instep of the foot to overlap a side of tongue 25. Medial side 22 has a similar configuration that generally corresponds with a medial surface of the foot. Accordingly, a portion of medial side 22 also extends over the instep of the foot to overlap an opposite side of tongue 25.

Heel portion 23 is configured to extend around a heel area of the foot and is formed integral with lateral side 21 and medial side 22. Similarly, toe portion 24 is configured to extend over a fore portion of the foot, including the toes. Like heel portion 23, toe portion 24 is generally formed integral with lateral side 21 and medial side 22 to reduce the number of seams in upper 20, thereby increasing the flexibility and overall comfort of upper 20.

Tongue 25 extends over the instep and is positioned under lace 26 and under portions of lateral side 21 and medial side 22. One skilled in the relevant art will recognize that this generally conventional structure serves the dual purpose of accommodating feet with various proportions and securing the foot within void 27. More particularly, the individual may selectively alter the relative position of lateral side 21 and medial side 22 by modifying the tension in lace 26, thereby causing upper 20 to expand and contract around the foot. By increasing the tension in lace 26, the volume of void 27 effectively decreases and lateral side 21 and medial side 22 are drawn against the surfaces of the foot. In this manner, upper 20 is tightened around the foot in order to securely and comfortably position the foot within void 27. By decreasing the tension in lace 26, however, the volume of void 27 increases and the foot may be withdrawn from void 27, for example.

The structure of upper 20 is generally sufficient to prevent the foot from being inadvertently removed from void 27 during an athletic competition, particularly when lace 26 is under a moderate degree of tension and upper 20 is drawn against the surfaces of the foot. In some circumstances, however, the foot may be inadvertently removed from void 27, thereby removing the foot from footwear 10. For example, heel portion 23 may be stepped on by another player in the game of soccer and a relatively high degree of forces may be applied to footwear 10. If the forces are sufficient to stretch upper 20 such that the heel slips out of contact with heel portion 23 and over ankle opening 28, then footwear 10 may become dislodged from the foot. In addition, if another individual steps upon heel portion 23 as the individual is running, then the same result may occur. In football, for example, the individual may be tackled by another individual, and the other individual may grasp upon footwear 10, thereby causing footwear 10 to become dislodged from the foot. Similar incidents may occur during practically any type of athletic competition or training session, including running, basketball, and tennis, for example. As will be discussed in greater detail below, leash 40 may be utilized to limit inadvertent removal of the foot from footwear 10.

Sole structure 30 includes two primary components, a support plate 31 and a plurality of cleats 32. Support plate 31 is a generally planar element that is secured to a lower surface of upper 20 and provides support for the foot. Cleats 32 are formed integral with support plate 31 and extend downward to form traction elements that engage the ground. Support plate 31 and cleats 32 may be formed of a semi-rigid polymer material, including a polyether block amide material, such as PEBAX, which is manufactured by the Atofina Company. Polyether block amide provides a variety of characteristics that benefit the present invention, including high impact resistance at low temperatures, few property variations in the temperature range of −40 degrees Celsius to positive 80 degrees Celsius, resistance to degradation by a variety of chemicals, and low hysteresis during alternative flexure. In addition, sole structure 30 may be formed from a nylon material, such as ZYTEL, which is manufactured by E.I. du Pont de Nemours and Company. Nylon materials offers efficient molding, relatively high toughness and impact resistance, and abrasion resistance, for example. Cleats 32 are primarily formed of the polymer material that forms support plate 31, but may include a tip formed of a rubber material that provides high wear-resistance. In addition, a metallic member may be located within cleats 32 to enhance stability and provide further wear-resistance.

In addition to support plate 31 and cleats 32, sole structure 30 may also incorporate a heel counter 33 that extends around heel portion 23 to ensure that the heel remains properly positioned with respect to upper 20. Heel counter 33 may be located on the exterior of heel portion 23, as depicted in the figures, or within the various material elements forming upper 20. Heel counter 33 is shown as being formed integral with support plate 31, but may also be formed separate from support plate 31. Sole structure 30 also includes a conventional insole 34 that is positioned within a lower portion of void 27 to contact the sole of the foot. In general, insole 34 is a thin, cushioning member that enhances the comfort of footwear 10.

The configuration of sole structure 30 described above is generally applicable to footwear 10, which is structured for use during the game of soccer. The sole structure of other types of footwear may vary significantly from the configuration of sole structure 30. For example, the sole structure of a running shoe, basketball shoe, and cross-training shoe may have a midsole formed of a polymer foam material, such as polyurethane or ethylvinylacetate, that attenuates shock and absorbs energy as the footwear contacts the ground. An outsole, formed of a durable rubber material, may also be secured to a lower surface of the midsole to provide the footwear with wear-resistance and traction.

Figure 2A:
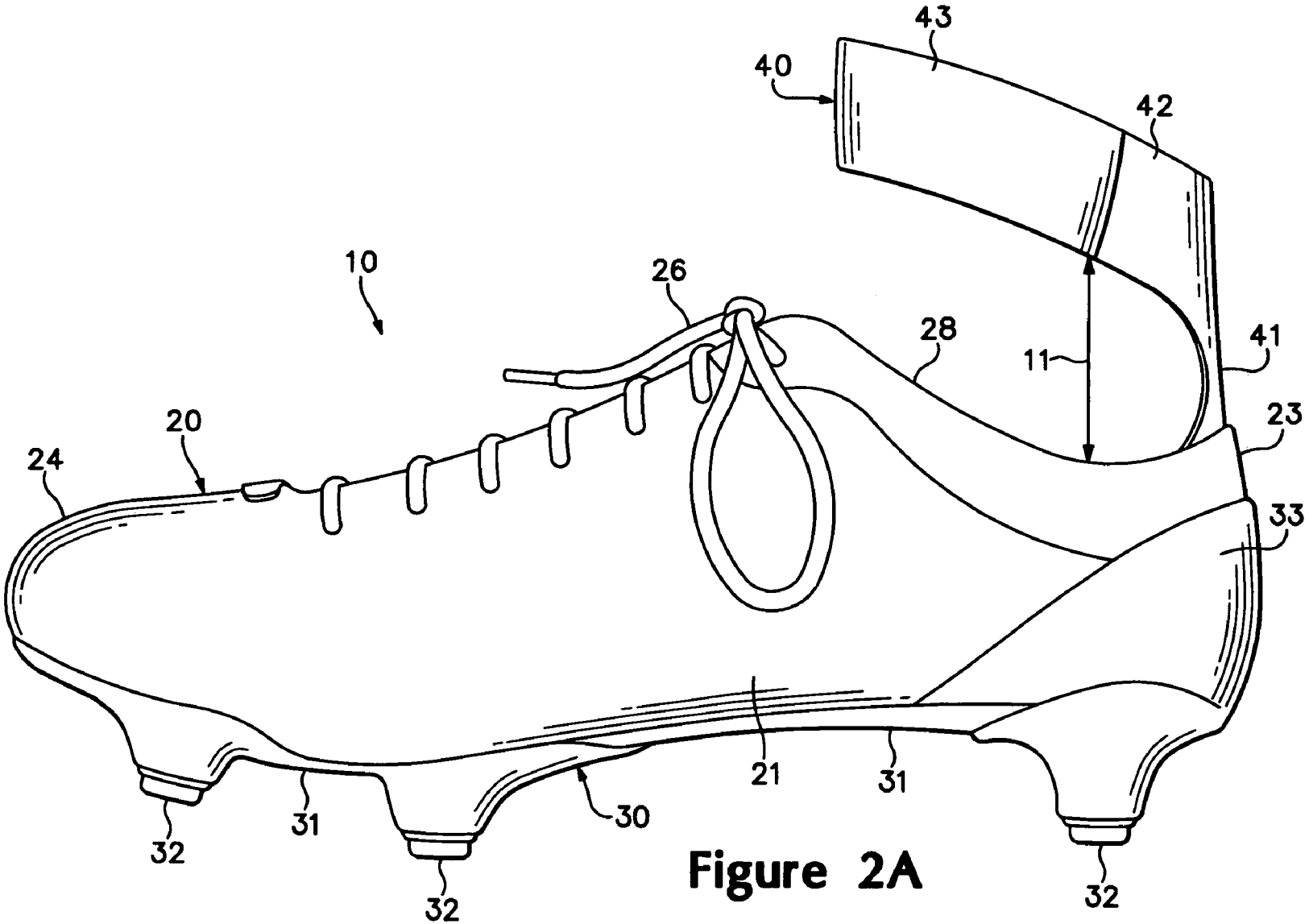
FIG. 2A is a lateral side elevational view of the footwear.
Figure 3:
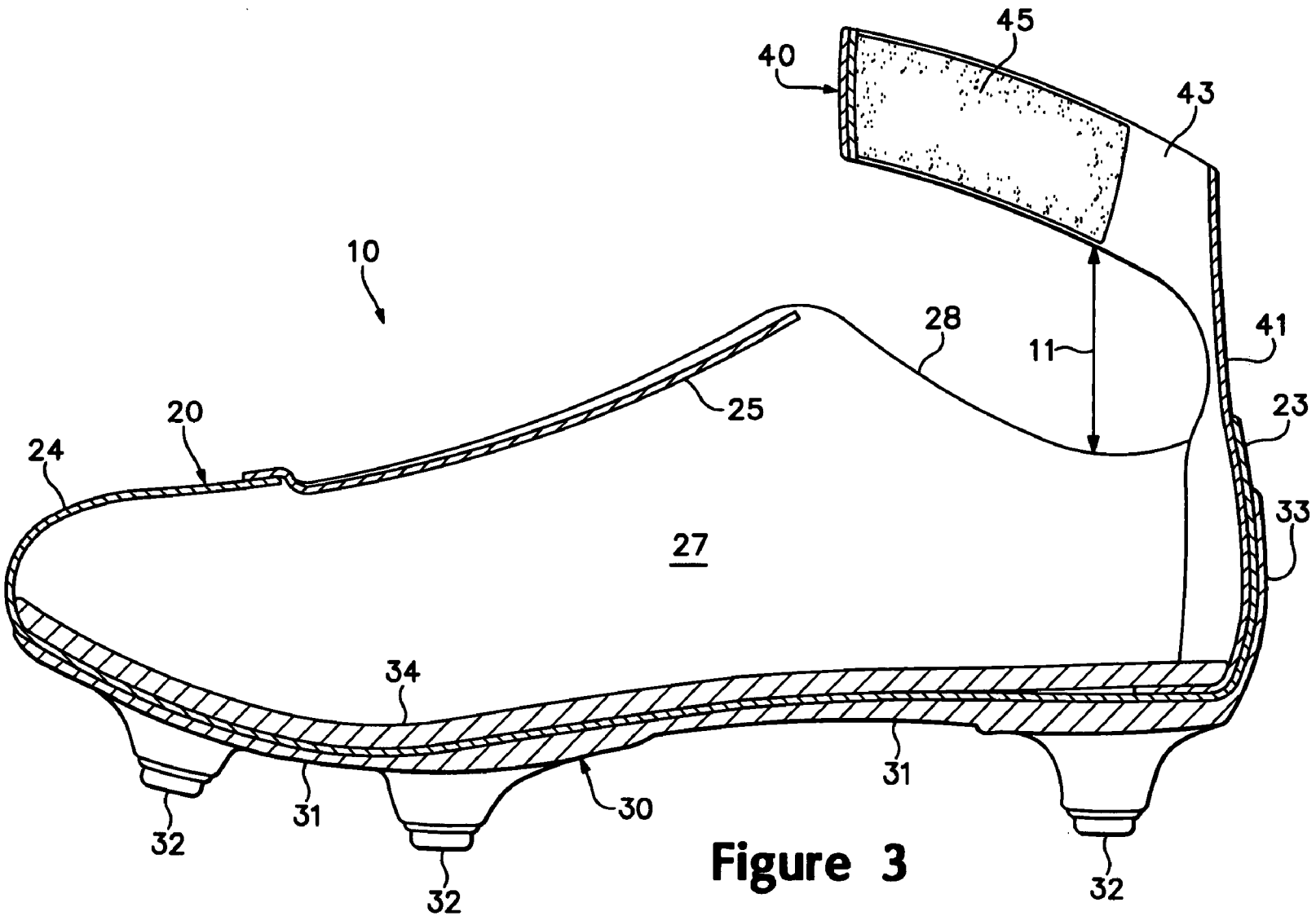
FIG. 3 is a cross-sectional view of the footwear as defined by line 3—3 in FIG. 1.
Figure 4:
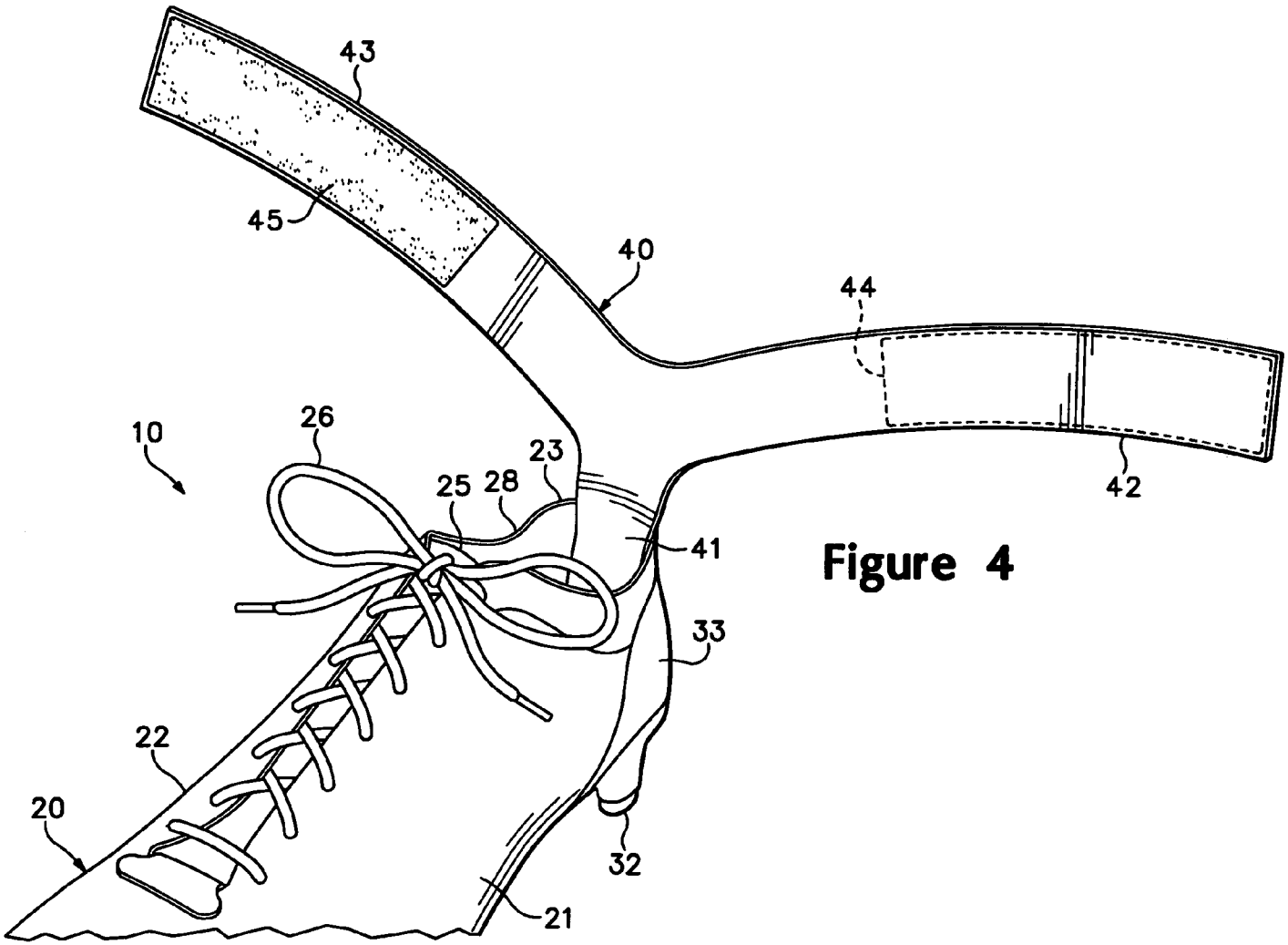
FIG. 4 is another perspective view of the footwear depicting the leash in an open configuration.
Figure 5:
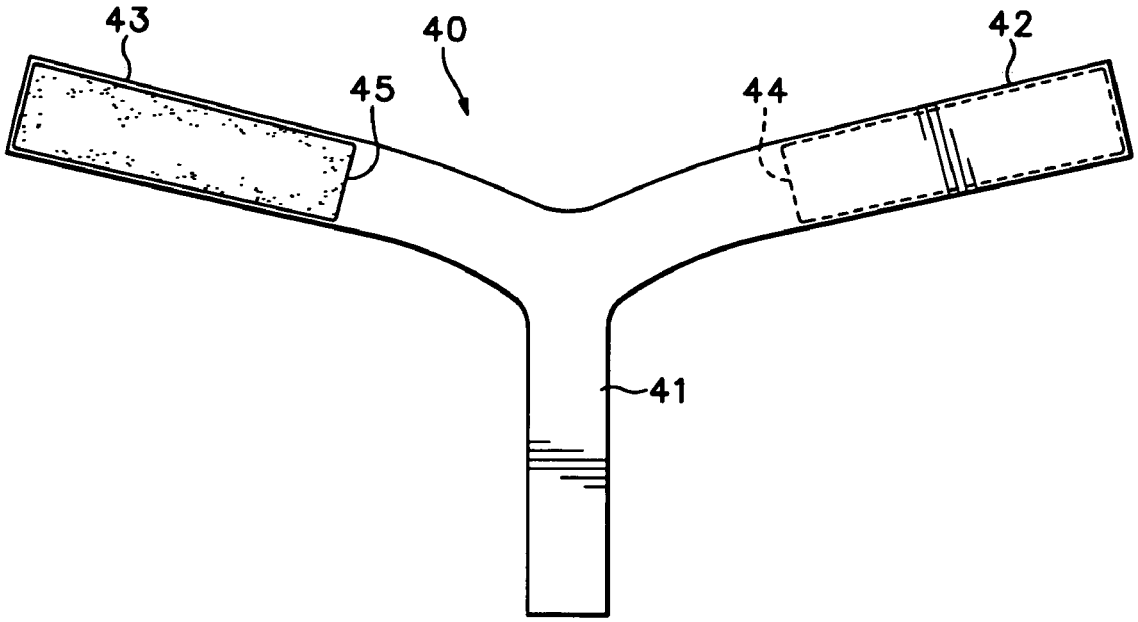
FIG. 5 is a plan view of an interior side of the leash.
Figure 6:
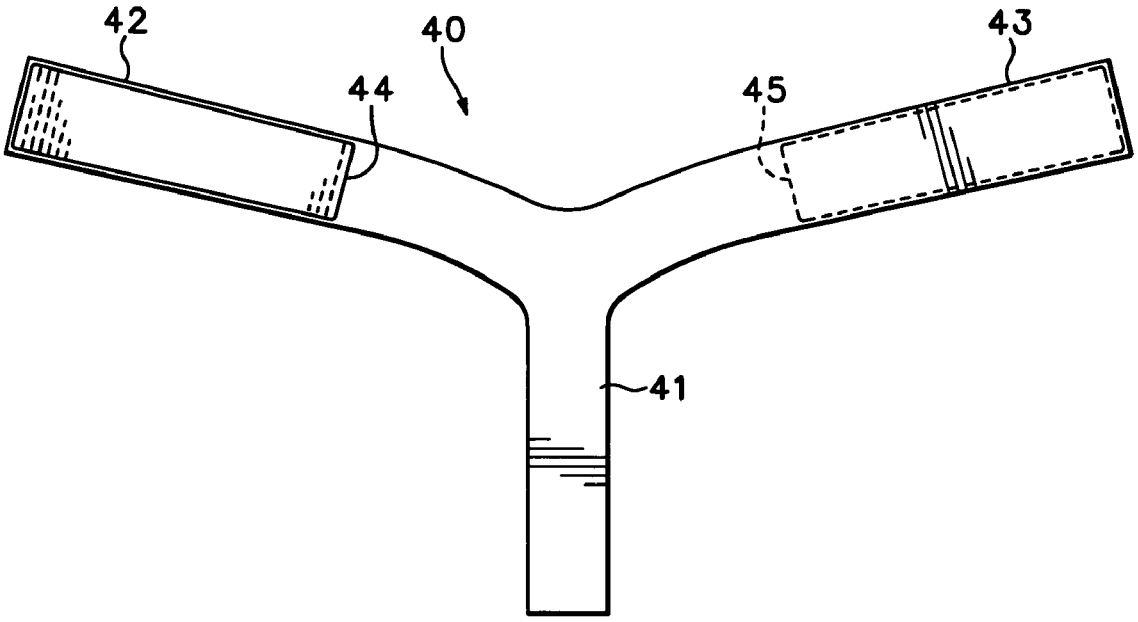
FIG. 6 is a plan view of an exterior side of the leash.

Leash 40 is secured to upper 20 and extends above ankle opening 28. The primary elements of leash 40 are a connector strap 41, a lateral strap 42 and a medial strap 43. As depicted in FIGS. 4, 5, and 6, for example, leash 40 has a Y-shaped configuration, wherein connector strap 41 forms the vertical segment and straps 42 and 43 form the inclined segments. Connector strap 41 secures leash 40 to upper 20 and retains a distance across a space 11, as defined in FIGS. 2A and 3, that is between ankle opening 28 and both of lateral strap 42 and medial strap 43. With reference to FIG. 3, connector strap 41 extends downward along the interior surface of heel portion 23, and a portion of connector strap 41 extends under insole 34 and between insole 34 and a lower area of upper 20. An adhesive or stitching process may be utilized to permanently secure connector strap 41 to upper 20.

Lateral strap 42 extends from an end of connector strap 41 and a first part 44 of a two-part fastener is secured to a surface of lateral strap 42. Similarly, medial strap 43 extends from the same end of connector strap 41 and a second part 45 of the two-part fastener is secured to an opposite surface of medial strap 43. Accordingly, lateral strap 42 and medial strap 43 join with connector strap 41 in a position that corresponds with the back of the heel, as viewed in FIG. 2B, and in a position that is below a lateral malleolus and a medial malleolus of the ankle. That is, the upper end of connector strap 41 is positioned at an elevation that is below the general elevation of the lateral malleolus and the medial malleolus. An incline in lateral strap 42 and medial strap 43 ensures that leash 40 extends over the lateral malleolus and the medial malleolus when worn by the individual. The incline is depicted with reference to angle 12 in FIG. 2B and illustrates the relation between the incline and a horizontal direction.

In operation, lateral strap 42 extends around a lateral side of the ankle and medial strap 43 extends around a medial side of the ankle. When medial strap 43 overlaps lateral strap 42, first part 44 contacts second part 45 and leash 40 is secured around the ankle. A downward force upon footwear 10, particularly heel portion 23 will place tension upon connector strap 41. Due to the connection between leash 40 and both of upper 20 and the ankle, however, movement of heel portion 23 relative to the foot will be limited, thereby limiting inadvertent removal of the foot from footwear 10.

Figure 2B:
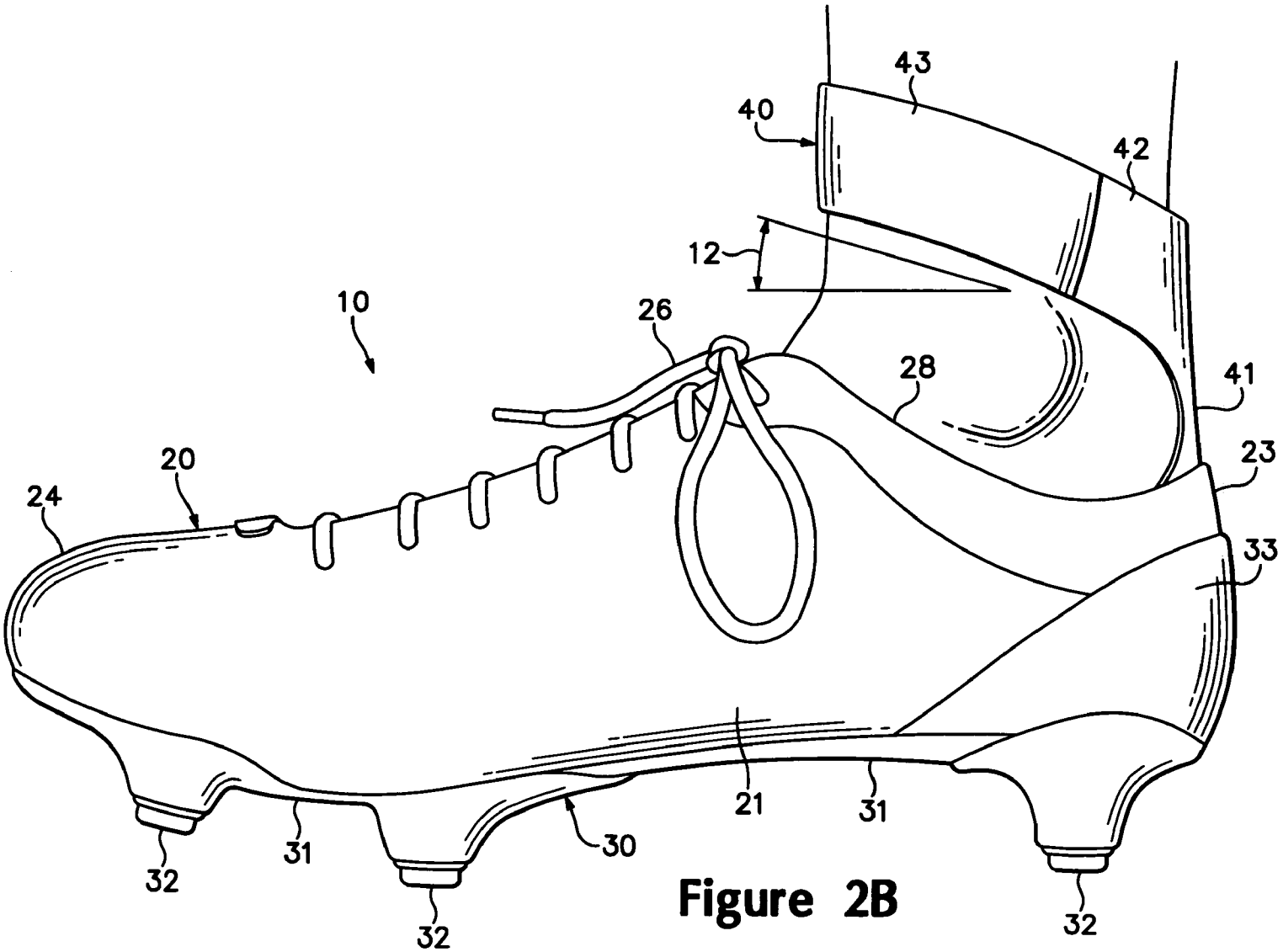
FIG. 2B is a lateral side elevational view of the footwear that corresponds with the view of FIG. 2A and depicts the footwear receiving a foot and the leash extending around an ankle.

The Y-shaped configuration of leash 40 forms the incline in lateral strap 42 and medial strap 43 when extending around the ankle. That is, lateral strap 42 and medial strap 43 are inclined relative to the horizontal direction when extending around the ankle. In combination with the length of connector strap 41, the incline is present to ensure that both of lateral strap 42 and medial strap 43 extend above the lateral malleolus and the medial malleolus, as depicted in FIG. 2B. In addition, the incline permits connector strap 41 to have a relatively short length, thereby placing the upper end of connector strap 41 below the general elevation of the lateral malleolus and the medial malleolus. As a downward force is applied to footwear 10, lateral strap 42 and medial strap 43 will contact the lateral malleolus and the medial malleolus, thereby restraining downward movement of footwear 10 and preventing the removal of footwear 10 from the foot.

In an alternate embodiment, leash 40 may have a T-shaped configuration. In order to ensure that lateral strap 42 and medial strap 43 extend above the lateral malleolus and the medial malleolus in the T-shaped configuration, the length of connector strap 41 may have to be increased accordingly due to the lack of an incline in lateral strap 42 and medial strap 43. A drawback to this configuration is that connector strap 41 has a longer configuration. Accordingly, the Y-shaped configuration is preferred.

The two-part fastener is depicted as a hook-and-loop fastener, such as VELCRO, which is manufactured by Velcro Industries B.V. An advantage of the hook-and-loop fastener structure is that the diameter of the loop formed by straps 42 and 43 when encircling the ankle may be easily adjusted by the individual to a desired size. In addition to hook-and-loop fasteners, however, a snap-type fastener, a magnetic fastener, or any other practical type of fastener may be utilized.

The materials forming connector strap 41 and straps 42 and 43 may vary significantly within the scope of the present invention. For example, these elements may be formed of natural or synthetic leather, a durable textile, or polymer sheet, such as vinyl, for example. The surface of leash 40 positioned to contact the ankle may also incorporate a moisture-wicking textile that removes perspiration from the area between leash 40 and the ankle, thereby limiting the quantity of moisture adjacent the ankle. As discussed above, the purpose of leash 40 is to limit inadvertent removal of the foot from footwear 10. Accordingly, a material that is substantially inextensible may have advantages over a highly-elastic material, for example. In addition, a material that is flexible and permits the foot and ankle to move in a full range of motion may also have advantages over an inflexible material. For these reasons, materials such as natural or synthetic leather, a durable textile, or a polymer sheet are suitable for leash 40.

One benefit of leash 40 relates to the flexible materials discussed above. As depicted in FIGS. 1, 2A, and 2B, for example, footwear 10 has the general configuration of a conventional soccer shoe, with the primary difference being the presence of leash 40. If leash 40 were formed of a stiff or inflexible material, then the individual may find that the range of motions necessary for the sport of soccer are limited by leash 40. When formed of a flexible material, however, leash 40 has a flexible configuration that does not limit the range of motions that are provided by a conventional soccer shoe, particularly inversion, eversion, dorsiflexion, and plantarflextion of the foot. Accordingly, the individual may utilize footwear 10 in the manner of a conventional soccer shoe, but with less risk that footwear 10 will be inadvertently removed from the foot. Similar considerations apply when a structure similar to leash 40 is added to other types of footwear, such as running shoes, basketball shoes, cross-training shoes, tennis shoes, and football shoes, for example.

Connector strap 41 is positioned adjacent heel portion 23 to promote the range of motions discussed above. More specifically, connector strap 41 is positioned at the back of heel portion 23 such that connector strap 41 extends along the back of the heel and ankle. If, for example, a pair of connector straps 41 extended along the sides of the ankle, rather than along the back of the ankle, then a natural degree of inversion or eversion, or side-to-side flexing, of the ankle may be limited. Accordingly, connector strap 41 extends from heel portion 23 such that inversion and eversion of the ankle is not limited.

Figure 7:
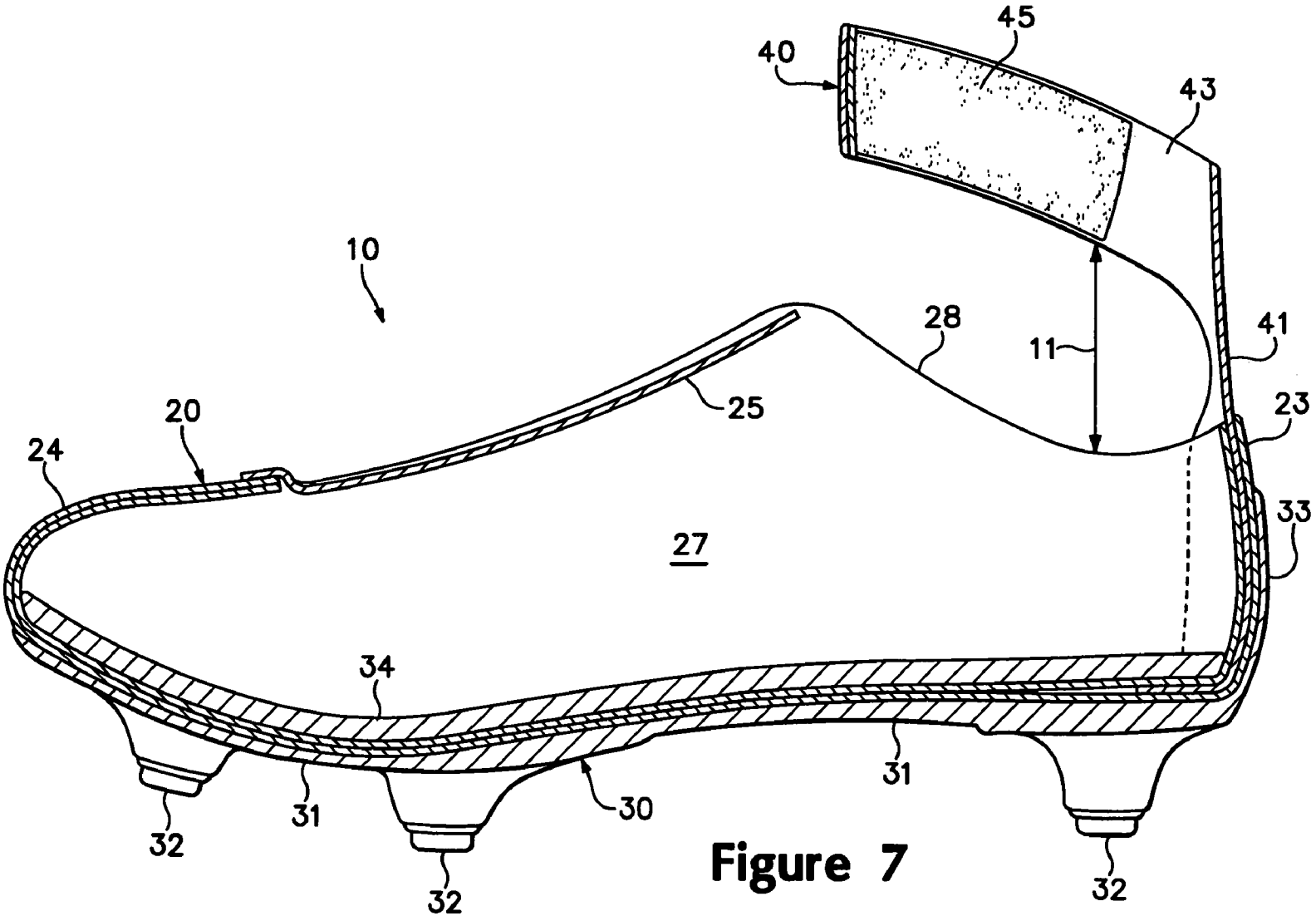
FIG. 7 is a cross-sectional view corresponding with FIG. 3 that depicts another embodiment of the present invention.
Figure 8:
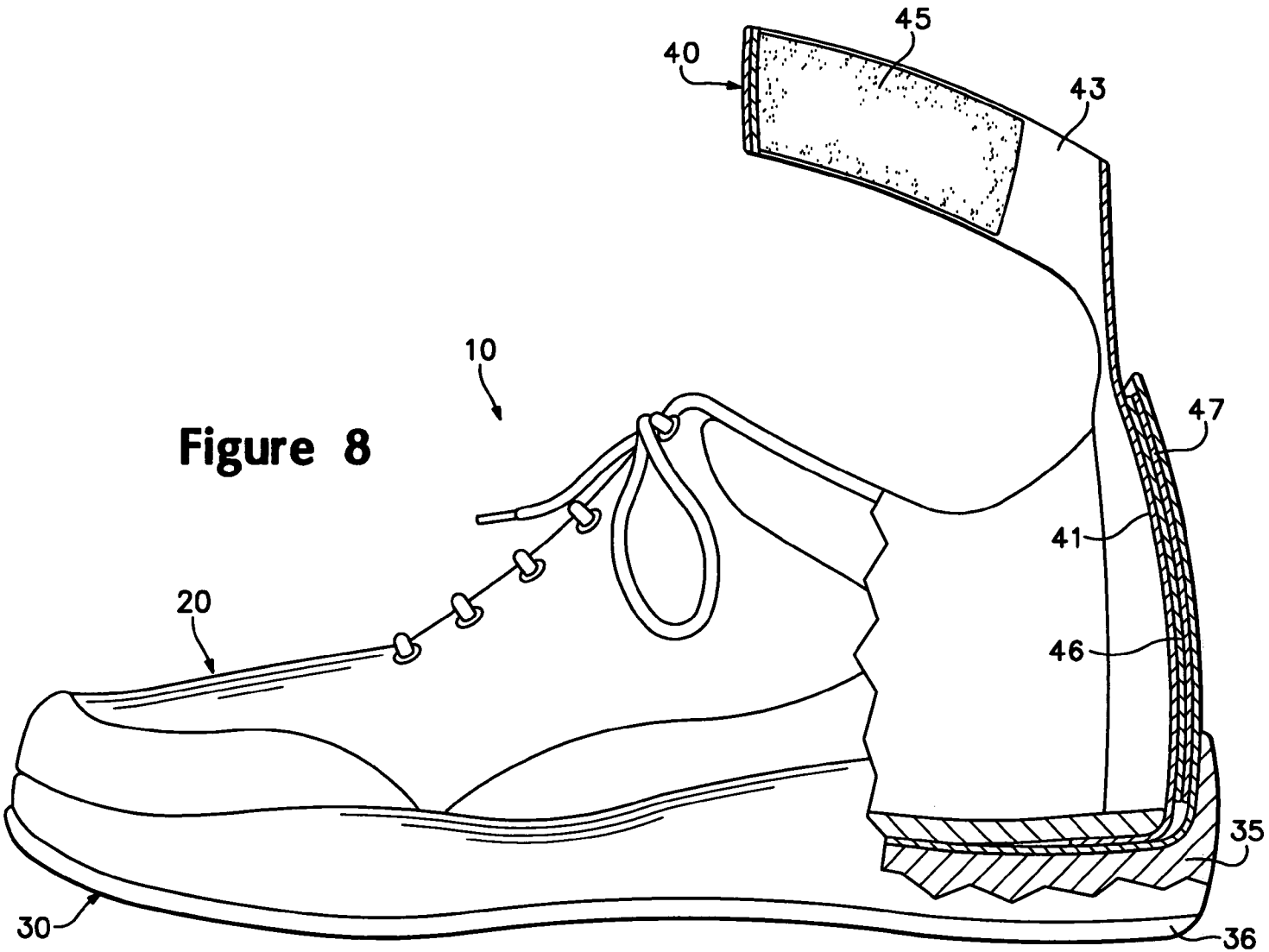
FIG. 8 is a partial cross-sectional view of yet another embodiment of the present invention.

As depicted in FIG. 3, connector strap 41 is positioned on an interior surface of upper 20. As an alternative to this configuration, FIG. 7 depicts an embodiment wherein connector strap 41 is embedded between two layers of material that form upper 20. The embodiments of FIG. 3 and FIG. 7 depict a configuration wherein connector strap 41 is permanently secured to upper 20. In some circumstances, however, the individual may wish to remove leash 40. Referring to FIG. 8, an article of footwear 10 having a configuration of a basketball shoe is depicted in cross-section. Footwear 10 has a conventional basketball shoe upper 20, and footwear 10 has a conventional sole structure 30 with a midsole 35 and an outsole 36. A leash 40 is detachably-secured to the inner surface of upper 20. More specifically, connector strap 41 is depicted as being secured to upper 20 with a hook-and-loop type fastener having a first part 46 and a second part 47. When the individual intends to remove leash 40, disconnection may be accomplished by disengaging first part 46 from second part 47. Similarly, leash 40 may be reconnected by engaging first part 46 with second part 47. An advantage to the configuration wherein leash 40 is detachably-secured to the inner surface of upper 20 relates to adjustability. When leash 40 is permanently secured to upper 20, the distance across space 11 is fixed. In the footwear of FIG. 8, however, the individual may modify the distance across space 11 to conform the specific anatomy or preferences of the individual.

The configurations of leash 40 discussed above are intended to provide an example of the many configurations that fall within the scope of the present invention. In another embodiment of leash 40, a single strap may extend from connector strap 41. The single strap may wrap entirely around the ankle and be secured with a d-ring fastener system, for example. In addition, corresponding portions of the hook-and-loop fastener may be on opposite sides of the single strap such that one portion of the fastener will engage the other portion when the single strap extends entirely around the ankle. In this embodiment, the single strap may have a configuration that is also inclined with respect to the horizontal direction such that the single strap extends above the lateral malleolus and medial malleolus.

Based upon the preceding discussion, leash 40 provides a structure that limits inadvertent removal of the foot from footwear 10. In general, the foot may be removed from footwear 10 when the heel slips out of contact with heel portion 23 and over ankle opening 28 such that the remainder of the foot may slide out of void 27. Leash 40, however, limits the relative movement that may occur between the heel and heel portion 23. Although leash 40 limits movement between the heel and heel portion 23, the flexible characteristics of leash 40 do not limit the range of movement, such as inversion, eversion, dorsiflexion, and plantarflextion, that would be available to the individual with a conventional article of footwear that does not include leash 40. Accordingly, leash 40 is effective in limiting inadvertent removal of the foot from footwear 10, without limiting the range of movement provided by conventional footwear.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An article of footwear comprising:

an upper having an interior surface and an opposite exterior surface, the interior surface defining a void shaped to correspond with and receive a foot, and the upper having an ankle opening that provides access to the void;

a sole structure including an insole positioned within the void and in a location that extends adjacent to a lower surface of the foot; and a leash having a Y-shaped configuration that includes:

a connector strap secured to the interior surface of the upper and having a length that extends from an area proximal the insole to an area above the ankle opening, the connector strap being positioned at a rear portion of the ankle opening to correspond in location with a heel of the foot, and the connector strap being absent from side areas of the ankle opening that correspond in location with a medial side and a lateral side of the foot, and a pair of ankle straps extending from an upper end of the connector strap, the ankle straps being spaced from the ankle opening and configured to extend around opposite sides of an ankle.

2. The article of footwear recited in claim 1, wherein the connector strap extends under the insole.

3. The article of footwear recited in claim 1, wherein the ankle straps are inclined relative to a horizontal direction when extending around the ankle.

4. The article of footwear recited in claim 1, wherein the ankle straps are configured to end above a lateral malleolus and a medial malleolus of the ankle.

5. The article of footwear recited in claim 4, wherein the upper end of the connector strap is at an elevation below the lateral malleolus and the medial malleolus.

6. The article of footwear recited in claim 1, wherein the leash is detachably-secured to the interior surface.

7. The article of footwear recited in claim 1, wherein the leash is permanently-secured to the interior surface.

8. An article of footwear comprising:

an upper having an interior surface and an opposite exterior surface, the interior surface defining a void shaped to correspond with and receive a foot, and the upper having an ankle opening that provides access to the void;

a sole structure including an insole positioned within the void and in a location that extends adjacent to a lower surface of the foot; and a leash having a Y-shaped configuration that includes:

a connector strap secured to the interior surface of the upper and positioned at a rear portion of the ankle opening to correspond in location with a heel of the foot, the connector strap being absent from side areas of the ankle opening that correspond in location with a medial side and a lateral side of the foot, and the connector strap having a first end and a second end, the first end being located within the void and under the insole, and the second end being located above the ankle opening and spaced from the ankle opening, and a pair of ankle straps extending from the second end of the connector strap, the ankle straps being spaced from the ankle opening and configured to extend around opposite sides of an ankle.

9. The article of footwear recited in claim 8, wherein the ankle straps are inclined relative to a horizontal direction when extending around the ankle.

10. The article of footwear recited in claim 8, wherein the ankle straps are configured to extend above a lateral malleolus and a medial malleolus of the ankle.

11. The article of footwear recited in claim 10, wherein an upper end of the connector strap is at an elevation below the lateral malleolus and the medial malleolus.

12. The article of footwear recited in claim 8, wherein the leash is detachably-secured to the interior surface.

13. The article of footwear recited in claim 8, wherein the leash is permanently-secured to the interior surface.

* * * * *